US006418906B1

(12) United States Patent
Cornell et al.

(10) Patent No.: US 6,418,906 B1
(45) Date of Patent: Jul. 16, 2002

(54) DURATION CONTROL STRATEGY FOR A HYDRAULICALLY ACTUATED ENGINE COMPRESSION RELEASE BRAKE

(75) Inventors: Sean O. Cornell, Gridley; Scott A. Leman, Eureka; David E. Martin, Normal; Ronald D. Shinogle, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/824,173

(22) Filed: Apr. 2, 2001

(51) Int. Cl.[7] ..... F02D 13/04
(52) U.S. Cl. ..... 123/322
(58) Field of Search ..... 123/320, 321, 123/322

(56) References Cited

U.S. PATENT DOCUMENTS 5,586,531 A 12/1996 Vittorio
5,746,175 A * 5/1998 Hu ..... 123/322
6,273,057 B1 * 8/2001 Schwoerer et al. ..... 123/321
6,321,701 B1 * 11/2001 Vorih et al. ..... 123/321

* cited by examiner

*Primary Examiner*—Erick Solis
(74) *Attorney, Agent, or Firm*—Liell & McNeil

(57) ABSTRACT

A method of engine compression release braking includes an initial step of compressing gas in an engine cylinder. A compression release brake valve is then opened at least in part by fluidly connecting a brake actuator to a source of high pressure actuation fluid. Next, a valve closing timing that results a valve seating velocity that is less than a pre-determined velocity is determined. The compression release brake valve is then closed at the valve closing timing at least in part by fluidly connecting the brake actuator to a low pressure actuation fluid reservoir.

20 Claims, 3 Drawing Sheets

DURATION CONTROL STRATEGY FOR A HYDRAULICALLY ACTUATED ENGINE COMPRESSION RELEASE BRAKE

TECHNICAL FIELD

The present invention relates generally to engine compression release braking, and more particularly to a strategy for reducing gas exchange valve seating velocities during engine braking.

BACKGROUND ART

The concept of engine compression release braking is well known in the art. In general, engine brakes are designed to open the exhaust valves or a special compression release valve of a internal combustion engine cylinder near the end of its compression stroke. As a result, the work done by the engine in compressing the air within the cylinder is not recovered during the expansion stroke of the piston, but rather is dissipated through the exhaust system of the engine.

Engine compression release brakes were first implemented using a cam to actuate the gas exchange valve at an appropriate timing. While these cam actuated braking systems have observed some success, the industry is driven to produce ever higher braking horsepowers and to introduce variable timing and control into compression release braking events. For instance, U.S. Pat. No. 5,586,531 to Vittorio teaches an engine braking cycle that purportedly achieves higher braking horsepowers through timing control of certain key events during a compression release braking cycle. Other recent innovations include the concept of two cycle engine braking, which is accomplished by performing a. braking event with each upward stroke of a piston. In still another relatively recent innovation, higher braking horsepowers are achieved by so called two event engine braking in which the individual cylinder is briefly opened to the exhaust manifold when the piston is near bottom dead center in order to boost the initial pressure of the cylinder and increase the mass therein. While all of these strategies can conceivably produce substantially higher braking horsepowers, for realistic implementation in an engine, there is a need for electronic control that can produce variable timing of all events independent of crank angle and engine speed.

Thus, there is a trend in the industry to introduce electronically controlled compression release brakes so that braking events can be controlled differently at different operating conditions. This trend finds an analogy in fuel systems for engines that have moved in the direction of permitting electronic control of fuel injection timing and quantity independent of engine speed and crank angle position. Caterpillar, Inc. of Peoria Illinois has observed considerable success in implementing electronically controlled hydraulically actuated fuel injection systems into their engines. It is believed that some of the high speed hydraulic technology developed in relation to fuel injection systems could also find potential application in actuating engine compression release brakes with high speed electronically controlled hydraulics that are independent of engine operating conditions. However, a switch from cam actuated engine brakes to hydraulically actuated engine brakes is not without the introduction of new problems. One such problem relates to limiting valve seating velocities in order to avoid accelerated seat wearing and valve stem fatigue.

Valve seating velocities are generally not a problem in cam actuated systems because the seating velocities are generally controlled by the shape of the cam profile to be generally less than about fifty centimeters per second. In the case of hydraulically actuated engine brakes, other strategies must utilized. One strategy includes the use of flow restrictions or so call "snubbers" to slow the movement rate of the exhaust valve member when returning toward its closed position. While a snubber strategy can reduce valve seating velocities at some operating conditions, there are often some operating conditions in which valve seating velocities are still unacceptably high. One source of high seating velocities can be due to residual high pressure in the cylinder when the valve member is moving toward its closed position. Such a circumstance could occur, for example, when the exhaust valve is commanded to close when cylinder pressure is still substantially higher than exhaust manifold pressure. In such a case, the residual pressure acts on the valve in a manner that tends to accelerate the same as it approaches its seated position.

The present invention is directed to these and other problems associated with hydraulically actuated compression release brakes.

DISCLOSURE OF THE INVENTION

A method of engine compression release braking includes an initial step of compressing gas in an engine cylinder. The compression release brake valve is then opened at least in part by fluidly connecting a brake actuator to a source of high pressure actuation fluid. A valve closing timing is then determined that will result in a valve seating velocity that is less than a pre-determined velocity. Finally, the compression release brake valve is closed at the valve closing timing at least in part by fluidly connecting the brake actuator to a low pressure actuation fluid reservoir.

In another aspect, an electronic control module includes a means for determining a valve opening timing for fluidly connecting a brake actuator to a source of high pressure actuation fluid. The module also includes a means for determining a valve closing timing for fluidly connecting the brake actuator to a low pressure actuation fluid reservoir that results in a valve seating velocity that is less than a pre-determined velocity.

In still another aspect, a-hydraulically actuated engine compression release braking system includes a engine compression release brake having a hydraulic brake actuator. A control valve has a first position in which the hydraulic brake actuator is fluidly connected to a source of high pressure fluid, and second position in which the hydraulic brake actuator is fluidly connected to a low pressure actuation fluid reservoir. An electronic control module is in control communication with the control valve and includes a means for determining a valve closing timing that results in a valve seating velocity that is less than a pre-determined velocity.

BEST MODE FOR CARRYING OUT THE INVENTION

Figure 1:
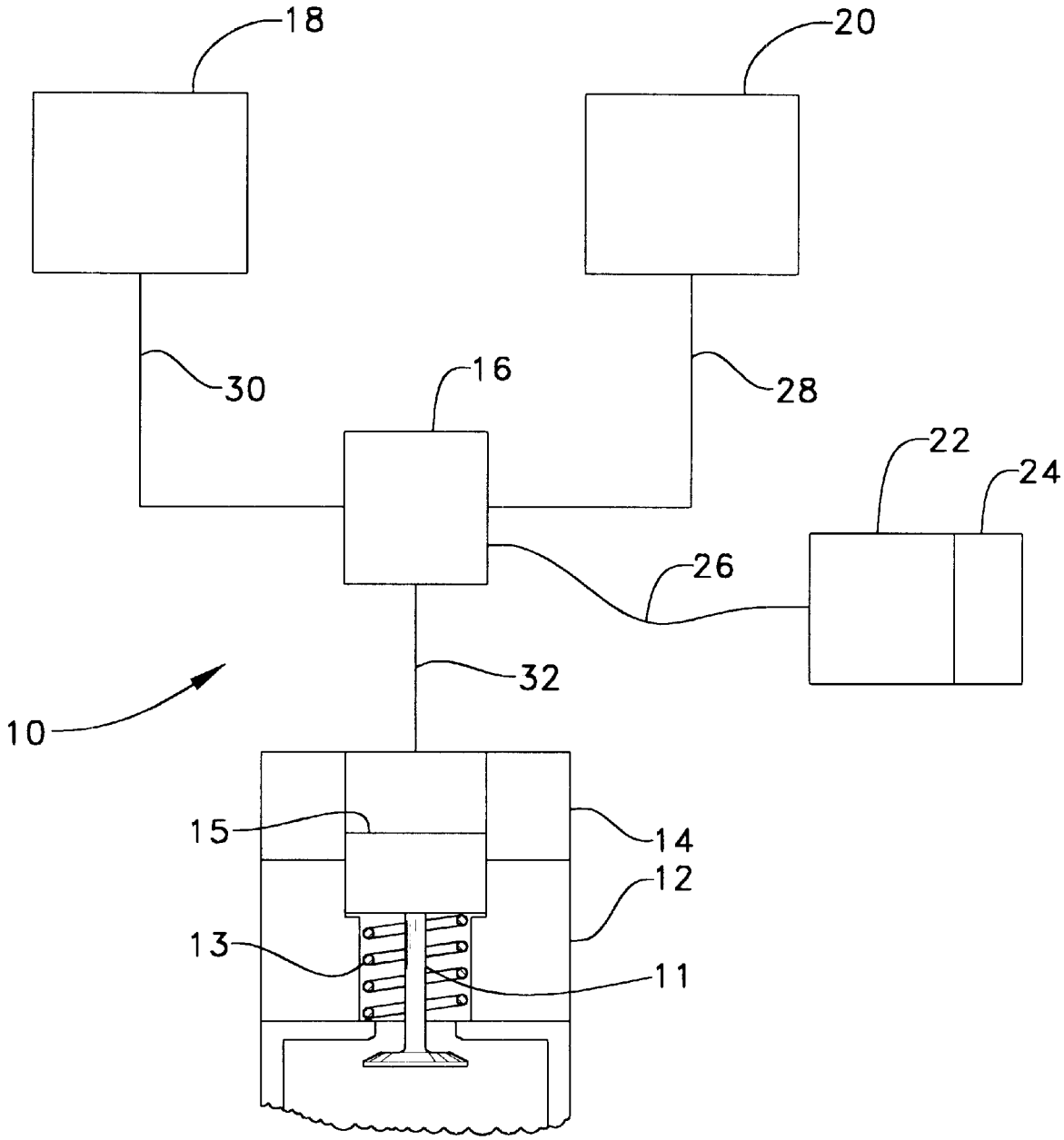
FIG. 1 is a schematic illustration of a hydraulically actuated engine compression release braking system according to the present invention.

Referring to FIG. 1, a hydraulically actuated engine compression release brake system 10 includes a brake valve 12, which is often an exhaust valve, operably coupled to a hydraulic brake actuator 14. Brake actuator 14 is fluidly connected to a control valve 16 via a fluid transfer line 32. Control valve 16 has first position in which fluid transfer line 32 is connected to a source of high pressure actuation fluid 18 via a high pressure line 30, and a second position in which fluid transfer line 32 is fluidly connected to a low pressure actuation fluid reservoir 20 via a low pressure line 28. The positioning of control valve 16 is controlled by an electronic control module 22 via a control communication line 26 in a conventional manner. Attached to, or included as a portion of, electronic control module 22 is a memory storage device 24 that has stored therein various data and possibly formulas or look up tables for use by the electronic control module in controlling various aspects of engine operation.

Control valve 16 is preferably biased to a position that fluidly connects fluid transfer line 32 to low pressure actuation fluid reservoir 20. This allows engine compression release brake valve 20 to be biased toward its closed position by the action of return spring 13. Thus, return spring 13 pushes piston 15 upward to evacuate fluid from brake actuator 14 toward low pressure actuation fluid reservoir 20. Opening of brake valve 12 is accomplished by moving control valve 16 to a position that opens a fluid communication between fluid transfer line 32 and source of high pressure actuation fluid 18. The pressure in source 18 is preferably high enough to overcome the action of return spring 13 such that the high pressure fluid acting on piston 15 pushes the same downward to open brake valve 12. When current to the electrical actuator that is part of control valve 16 is terminated, control valve 16 returns to its biased position and reconnects brake actuator 14 to low pressure actuation fluid reservoir 20.

Those skilled in the art will appreciate that several factors play a role in determining the rate at which valve member 11 moves from its open position to its closed position, especially its speed at the time the valve impacts its seat. Among these factors are the strength of return spring 13 and the rate at which fluid can be evacuated from the volume above piston 15. Another important factor is the pressure differential between the piston cylinder and the exhaust line, which can result in a net pressure force acting on valve member 11 pushing it toward its closed position. Snubbers and other related technology are directed to controlling the rate at which fluid can be evacuated from the volume above piston 15, and hence control the impact velocity of valve member 11. However, these strategies cannot reliably work across the engine's operating range unless the pressure differential at the time of closing between the piston cylinder and the exhaust manifold are such that any pressure force acting on valve member 11 does not overwhelm other included features for limiting valve impact velocity. The present invention is directed toward reducing the pressure differential between the engine cylinder and the exhaust line at the time the valve is moving from its open position to its closed position so that cylinder pressure is effectively removed as a contributor to determining valve impact velocity. In other words, by lowering pressure differentials between the piston cylinder and the exhaust manifold, the rate at which valve member 11 moves from its open position to its closed position is substantially only a function of spring strength 13 and the rate at which fluid is evacuated from the volume above piston 15, which can be controlled in a manner well known in the art.

Figure 2:
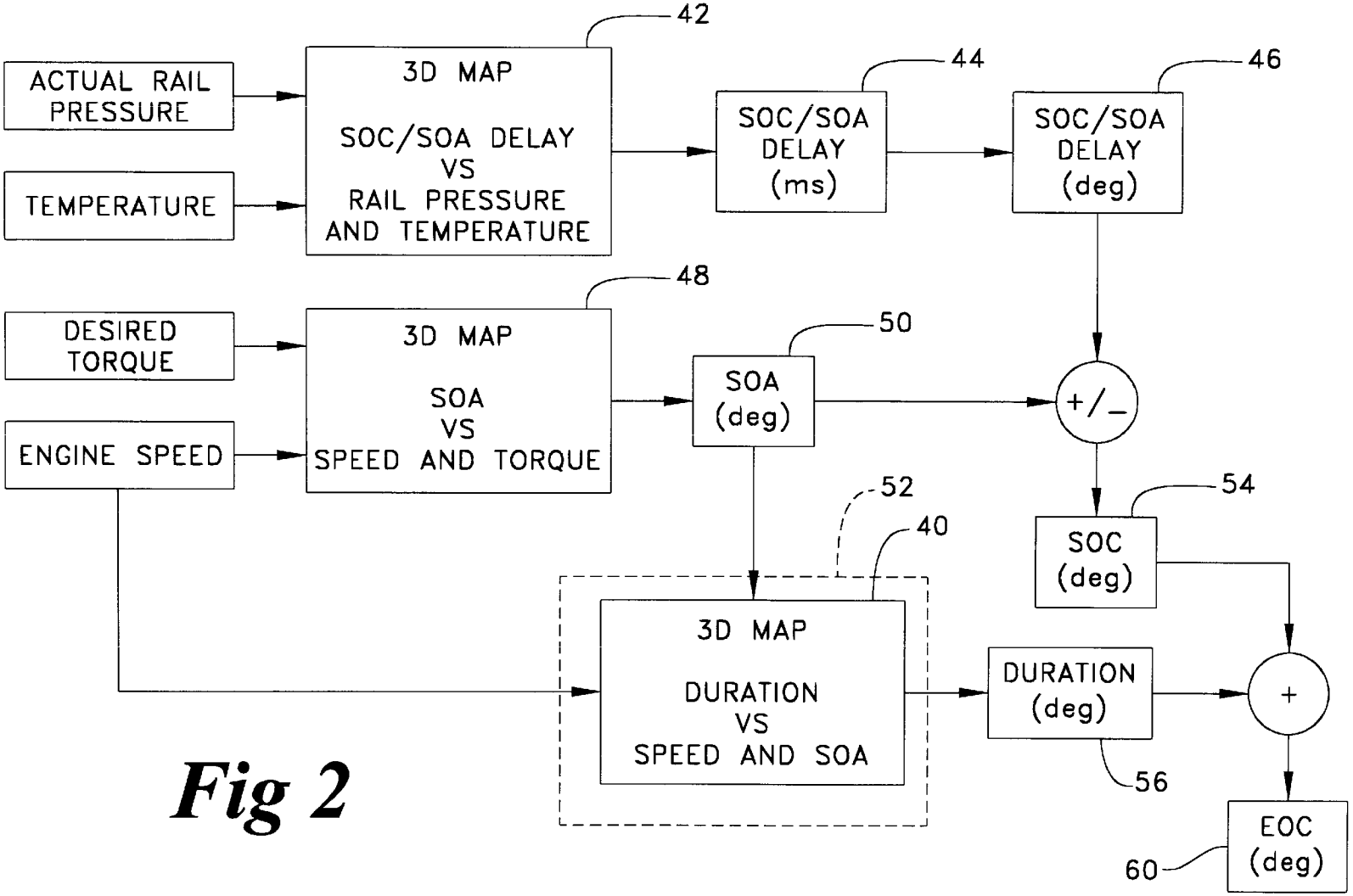
FIG. 2 is a logic flow diagram for performing engine compression release braking according to a preferred version of the present invention.

Referring in addition to FIG. 2, an engine compression release braking control strategy according to the preferred embodiment of the present invention is illustrated. In this strategy, the electronic control module determines a valve activation delay determination 42 based upon actual rail pressure and actuation fluid temperature. This delay is identified in FIG. 2 as SOC/SOA delay, which stands for start of current/start of activation delay. Actual rail pressure refers to the fluid pressure in the source of high pressure actuation fluid 18, while temperature of the actuation fluid is used to determine the viscosity of the actuation fluid, which has a strong influence on determining the delay between the start of the current to the electrical actuator for control valve 16 verses when the brake valve 12 actually starts moving from its closed position toward its open position. By knowing the performance characteristics of the various components of the braking system 10, one preferably develops a three dimensional look up table or map of SOC/SOA delay verses rail pressure and temperature. After retrieving the value from the 3-D map, the SOC/SOA delay is carried forward in box 44 as time units, such as milliseconds. The electronic control module then converts this delay in time units to a delay in crank angle degrees 46. This number is used by the electronic control module to determine at what crank angle current should be sent to the electrical actuator for control valve 16 in order for the valve to activate at its desired timing.

The start of valve activation timing (SOA) is accomplished at box 48 as a function of desired braking torque and engine speed. Those skilled in the art will recognize that a three dimensional map or look up table of start of valve activation timing verses engine speed and desired braking torque can be developed through conventional testing techniques and stored in a memory location 24 that is accessible to electronic control module 22. This map preferably produces a start of actuation valve timing as a function of crank angle degree and is carried forward in box 50. The electronic control module then combines the SOC/SOA delay from box 46 with the start of valve activation SOA carried forward from box 50 to arrive at the start of current timing in crank angle degrees 54. Thus, in order for brake valve 12 to open at the desired start of valve activation, the electronic control module sends current to the electrical actuator for control valve 16 at the start of current timing identified in box 54. The next step in the process is to determine an end of current (EOC) in crank angle degrees as in box 60 in order to define the end of one engine braking event. In other words, one engine braking event is defined by the start of current and the end of current.

In order to determine the end of the current, the present invention utilizes a braking duration determination 40 that can be accomplished in a variety of ways depending upon the desired accuracy of the result and other factors. In the embodiment illustrated in FIG. 2, a look up table or 3-D map of valve opening duration 52 is stored at a storage location 24 accessible to electronic control module 22. This 3-D map calculates the necessary duration of the valve opening in order for the valve impact velocity to be below a predetermined maximum, such as sixty centimeters per second. In the preferred version, this three dimensional map of valve opening duration is a function of engine speed and the start of valve activation timing (SOA). This look up table or 3-D map is created through appropriate testing at a variety of engine speeds. In other words, one can determine a valve opening duration for a given engine speed and start of valve activation that will result in a relatively low pressure differential between the engine cylinder and the exhaust manifold at the time current to the electrical actuator for control valve 16 is terminated (EOC). In this way, if the other features, including return spring 13 and the fluid evacuation rate above piston 15, are chosen to result in a pre-determined valve seating velocity, then by choosing an appropriate valve opening duration, pressure forces will be substantially removed from the equation determining valve seating velocity. In other words, the valve seating velocity will be kept below a pre-determined seating velocity, which is primarily a function of performance characteristics of engine brake valve 12, brake actuator 14, control valve 16, etc. After retrieving the desired valve opening duration from determination 52, the duration in crank angle degrees 56 is carried forward. Finally, the end of current in crank angle degrees 60 is calculated by adding the start of current in crank angle degrees 54 to the valve open duration in crank angle degrees 56. The end result should be an engine braking event that produces a desired amount of retarding torque on the engine and a valve impact velocity that is less than a pre-determined velocity.

Figure 3:
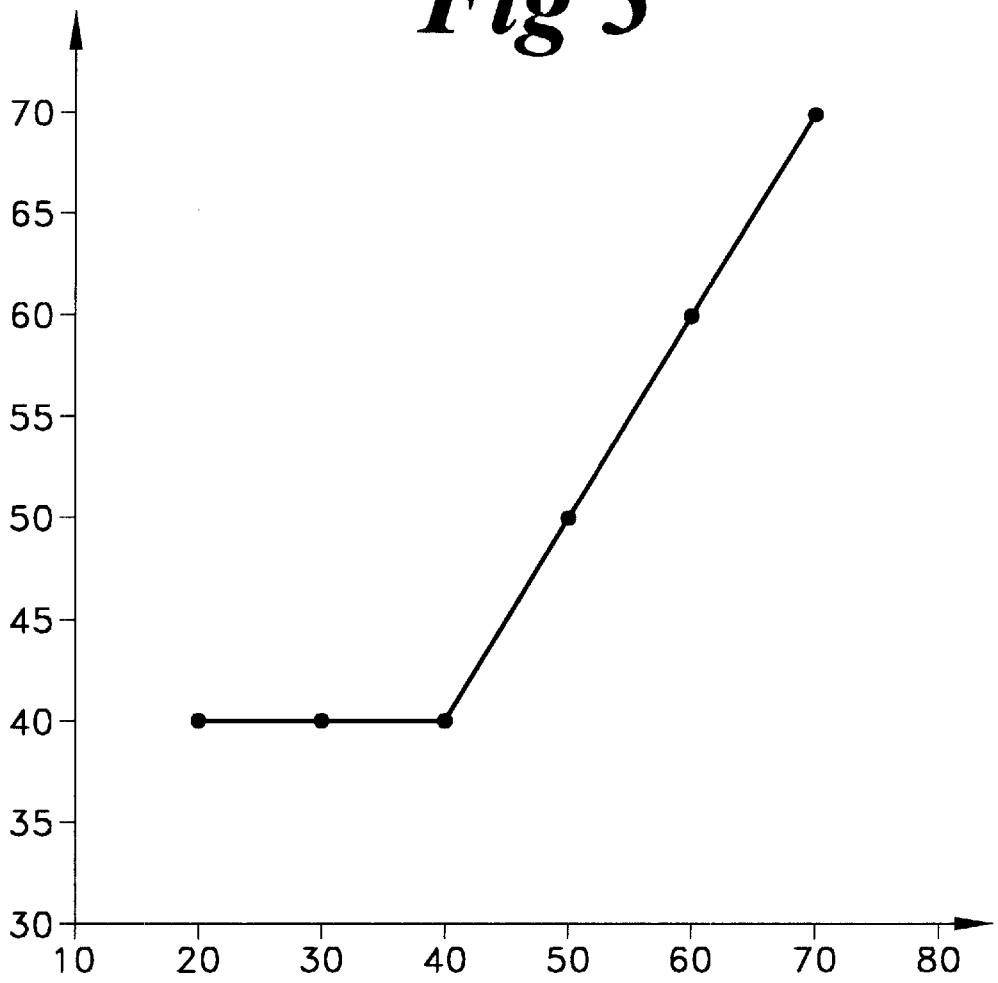
FIG. 3 is a graph of valve opening duration in crank angle degrees versus valve opening timing in degrees before top dead center according to another aspect of the present invention.

Referring to FIG. 3, a 2-D map or look up table of valve open duration in crank angle degrees is graphed against the start of valve activation (SOA) in crank angle degrees before top dead center. Thus, the strategy of FIG. 3 is similar to that of FIG. 2 except that the valve open duration no longer takes into consideration engine speed. In this example strategy engine brake valve 12 is never commanded to close before the piston reaches top dead center, regardless of when the valve opens. Furthermore, this strategy maintains the valve open passed top dead center when the same opens less than 40° before top dead center. Through testing, this strategy for an individual application could successfully insure substantially complete blow down of pressure from the engine cylinder before the brake valve is commanded to close.

Those skilled in the art will also appreciate that the graph of FIG. 3 could be incorporated as a look up table or 3-D map in a relatively straight forward manner into memory storage device 24 that is accessible to electronic control module 22. Those skilled in the art will appreciate that the present invention also contemplates other alternatives to the 3-D map valve opening duration 52 of FIG. 2 and the two dimensional map of valve opening duration verses start of valve activation of FIG. 3. For instance, a hybrid of the two strategies might be to utilize the simple strategy of FIG. 3 unless engine speed is above some predetermined speed in which case a different strategy is used. This different strategy above the pre-determined engine speed could be to utilize a 3-D map such as that illustrated in FIG. 2 or possibly set a valve closing timing to occur at a fixed crank angle degree, such as for instance 60° past top dead center in order to insure adequate blow down of pressure from the engine cylinder before the same is commanded to close. Such a strategy would be confirmed through testing before being implemented in an individual engine application to insure that the valve closing timing results in a valve impact velocity that is less than a pre-determined velocity.

Industrial Applicability

The present invention finds potential application in many electronically controlled engine compression release brake system, but is particularly applicable to electronically controlled hydraulically actuated engine brake systems. The present invention is preferably implemented by first designing engine brake components to produce valve impact velocities that are less than a pre-determined velocity. Preferably, the various components are designed to produce an impact velocity less than about sixty centimeters per second in order to allow the valve member and seating component to be manufactured from time tested materials that have shown satisfactory resistance to wear and fatigue. Over many years, engineers have come to recognize that cam actuated valves are designed to have impact velocities less than about 60 centimeters per second, and often as low as 30 to 40 centimeters per second. Once the system design is shown to produce impact velocities less than the pre-determined velocity, the next step is to take steps to insure that pressure differentials between the piston cylinder and the exhaust manifold are sufficiently low as to not overly influence the closure rate of the engine brake valve, which is typically the engine's exhaust valve.

Determining valve opening durations that insure adequate blow down before the valve is commanded to close can be accomplished in any of the illustrated manners and any suitable variations thereon. Among these illustrated strategies are a valve opening duration that is a function of engine speed and valve opening timing, a two dimensional strategy in which valve opening duration is a function of only the valve opening timing, and a third strategy in which the valve closing timing is set to occur at some pre-determined crank angle after top dead center. In general, the first alternative will likely result in the lowest consumption of power as resulting in efficient valve opening durations, but will likely involve considerable more data processing and memory storage demands for a relatively large three dimensional map or look up table. The last alternative of simply setting a fixed valve closing timing that occurs at some point after piston top dead center could be relatively affective and simple to implement, but in practice could result in an excessive power draws since the electrical actuator for the control valve 16 (FIG. 1) would often be held open far longer than would be necessary to accomplish the goals of the present invention. In any event, implementation of any of these strategies should result in the ability to perform engine braking events across all engine operating conditions while maintaining impact velocities below a pre-determined velocity.

Those skilled in the art will appreciate that various modifications could be made to the illustrated embodiments without departing from the intended scope of the present invention. Thus, those skilled in the art will appreciate that any of the disclosed alternatives or combinations thereof could be implemented in different combinations depending on such concerns as accuracy, data processing capabilities, data storage abilities and power consumption, etc. Those skilled in the art will appreciate that other aspects, objects and advantages of this invention can be obtained from a study of the drawings, the disclosure and the appended claims.

What is claimed is:

1. A method of engine compression release braking, comprising the steps of:

compressing gas in an engine cylinder;

opening a compression release brake valve at least in part by fluidly connecting a brake actuator to a source of high pressure actuation fluid;

determining a valve closing timing that results in a valve seating velocity that is less than a predetermined velocity;

closing the compression release brake valve at the valve closing timing at least in part by fluidly connecting the brake actuator to a low pressure actuation fluid reservoir.

2. The method of claim 1 wherein said determining step includes a step of determining a valve opening timing.

3. The method of claim 2 wherein said step of determining a valve closing timing includes a step of determining a valve open duration as a function of said valve opening timing.

4. The method of claim 3 wherein said step of determining a valve open duration includes a step of accessing a look-up table of valve open duration versus valve opening timing.

5. The method of claim 3 including a step of estimating engine speed; and determining a valve open duration as a function of said valve opening timing and engine speed.

6. The method of claim 5 wherein said step of determining a valve open duration includes a step of accessing a look-up table of valve open duration versus valve opening timing and engine speed.

7. The method of claim 1 wherein said step of determining a valve closing timing includes a step of setting the valve closing timing to occur at a fixed engine crank angle.

8. The method of claim 1 wherein said predetermined velocity is 60 cm/sec.

9. The method of claim 1 including a step of setting the valve closing timing to occur before a beginning of an exhaust event.

10. An electronic control module comprising:

means for determining a valve opening timing for fluidly connecting a brake actuator to a source of high pressure actuation fluid; and means for determining a valve closing timing for fluidly connecting the brake actuator to a low pressure actuation fluid reservoir that results in a valve seating velocity that is less than a predetermined velocity.

11. The electronic control module of claim 10 wherein said valve closing timing is a function of the valve opening timing.

12. The electronic control module of claim 11 including means accessing a look-up table of valve open duration versus valve opening timing.

13. The electronic control module of claim 11 including means for estimating engine speed; and means for accessing a look-up table of valve open duration versus valve opening timing and engine speed.

14. The electronic control module of claim 11 wherein said means for determining a valve closing timing includes a means for setting the valve closing timing to occur at a fixed engine crank angle.

15. The electronic control module of claim of claim 11 wherein said predetermined velocity is 60 cm/sec.

16. A hydraulically actuated engine compression release braking system comprising:

an engine compression release brake including a hydraulic brake actuator;

a control valve having a first position in which said hydraulic brake actuator is fluidly connected to a source of high pressure fluid, and a second position in which said hydraulic brake actuator is fluidly connected to a low pressure actuation fluid reservoir; and an electronic control module in control communication with said control valve and including means for determining a valve closing timing that results in a valve seating velocity that is less than a predetermined velocity.

17. The braking system of claim 16 wherein said valve closing timing is a function of a valve opening timing.

18. The braking system of claim 17 wherein said valve closing timing is a function of engine speed.

19. The braking system of claim 16 including a look-up table of valve closing timing versus at least one other variable and being stored in a location accessible to said electronic control module.

20. The braking system of claim 16 wherein said predetermined velocity is 60 cm/s.

* * * * *